US010008786B2

(12) United States Patent
Brantingham

(10) Patent No.: US 10,008,786 B2
(45) Date of Patent: Jun. 26, 2018

(54) COAXIAL-CABLE-ASSEMBLY, FERRULE, AND METHOD OF MAKING THE SAME

(71) Applicant: Delphi Technologies, Inc., Troy, MI (US)

(72) Inventor: Duane L. Brantingham, Cortland, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days. days.

(21) Appl. No.: 15/336,923

(22) Filed: Oct. 28, 2016

(65) Prior Publication Data

US 2018/0123263 A1 May 3, 2018

(51) Int. Cl.

| | |
|---|---|
| ***H01R 43/048*** | (2006.01) |
| ***H01R 13/193*** | (2006.01) |
| ***H01R 4/48*** | (2006.01) |
| ***H01R 13/428*** | (2006.01) |
| ***H01R 24/38*** | (2011.01) |
| *H01R 103/00* | (2006.01) |

(52) U.S. Cl.

CPC ..... *H01R 4/4818* (2013.01); *H01R 13/193* (2013.01); *H01R 13/428* (2013.01); *H01R 24/38* (2013.01); *H01R 43/048* (2013.01); *H01R 2103/00* (2013.01)

(58) Field of Classification Search

CPC ..... H01R 4/4818; H01R 4/18; H01R 9/0521; H01R 9/05; H01R 9/0518; H01R 9/0757; H01R 13/658; H01R 13/65807; H01R 13/428; H01R 13/193; H01R 43/048; H01R 2103/00

USPC ..... 439/578, 584, 585

See application file for complete search history.

(56) References Cited

U.S. PATENT DOCUMENTS

| | | | | | |
|---|---|---|---|---|---|
| 1,978,047 | A | | 10/1934 | Haury | |
| 2,379,567 | A | * | 7/1945 | Buchanan | H01R 4/206 439/868 |
| 3,034,094 | A | * | 5/1962 | Watson | H01R 4/12 439/712 |
| 3,241,098 | A | * | 3/1966 | Cobaugh | H01R 4/20 439/730 |
| 3,286,223 | A | * | 11/1966 | Anderson | H01R 4/00 439/877 |
| 3,364,460 | A | * | 1/1968 | Bergan | H01R 4/187 228/173.5 |

(Continued)

FOREIGN PATENT DOCUMENTS

WO 2010119011 A1 10/2010

*Primary Examiner* — Amy Cohen Johnson
*Assistant Examiner* — Milagros Jeancharles
(74) *Attorney, Agent, or Firm* — Robert J. Myers

(57) ABSTRACT

A coaxial-cable-assembly includes a coaxial-cable and a tubular-ferrule. The coaxial-cable includes an outer-jacket and an exposed outer-shield conductor. The tubular-ferrule includes a crimp-zone, a skirt-zone, and a transition-zone therebetween. The tubular-ferrule defines a relief-slot having an open-end, a closed-end, and two parallel-edges that extend from the crimp-zone to the skirt-zone. The crimp-zone is brought into forcible contact with the exposed outer-shield conductor by drawing the two parallel-edges into close proximity, such that a crimp-zone-diameter is reduced to less than a skirt-zone-diameter. As a result, the closed-end of the relief-slot forms an aperture in a junction of the transition-zone and the skirt-zone.

17 Claims, 4 Drawing Sheets

(56) References Cited

U.S. PATENT DOCUMENTS 3,923,367 A * 12/1975 Carter ..... H01R 9/0518 439/585
3,955,044 A * 5/1976 Hoffman ..... H01R 4/203 174/84 C
4,272,148 A 6/1981 Knack, Jr.
4,307,926 A 12/1981 Smith
4,431,256 A * 2/1984 Piscitelli ..... H01R 13/111 439/843
4,470,658 A * 9/1984 Hemmer ..... H01R 13/11 439/843
5,051,543 A * 9/1991 McGuire ..... H01R 4/203 16/108
5,340,230 A * 8/1994 Anderson ..... H01R 4/027 174/74 R
5,562,482 A * 10/1996 Wright ..... H01R 9/0521 439/394
5,762,526 A * 6/1998 Kuramoto ..... F04C 23/008 439/874
5,897,404 A * 4/1999 Goodman ..... H01R 13/187 439/843
6,666,732 B1 * 12/2003 Endacott ..... H01R 4/187 439/730
6,753,475 B2 * 6/2004 Takahashi ..... H01R 9/0518 174/75 C
6,808,417 B2 * 10/2004 Yoshida ..... H01R 9/0518 439/585
6,860,760 B2 * 3/2005 Endo ..... H01R 24/40 439/578
7,160,150 B2 * 1/2007 Annequin ..... H01R 43/048 439/585
7,232,341 B2 * 6/2007 Shinmyo ..... H01R 13/6592 439/607.51
7,422,480 B1 * 9/2008 Musick ..... H01R 9/0518 439/585
8,262,421 B2 * 9/2012 De Blieck ..... H01R 43/16 439/357
8,366,483 B2 2/2013 Hardy et al.
9,142,895 B2 * 9/2015 Hardy ..... H01R 9/0518
9,293,838 B2 * 3/2016 Sakaguchi ..... H01R 4/62
9,537,231 B2 * 1/2017 Hall ..... H01R 9/0518
9,608,427 B2 * 3/2017 Fulponi ..... H02G 15/043
2005/0176265 A1 * 8/2005 Jacobs ..... H01R 13/11 439/35
2008/0050988 A1 2/2008 Burger
2010/0075545 A1 * 3/2010 De Blieck ..... H01R 43/02 439/741
2011/0083324 A1 * 4/2011 Martauz ..... H01R 4/185 29/863
2011/0207363 A1 * 8/2011 Shimizu ..... H01R 13/111 439/374
2012/0214339 A1 * 8/2012 Stein ..... H01R 13/111 439/578
2014/0273667 A1 * 9/2014 Tachibana ..... H01R 43/048 439/877
2015/0017833 A1 * 1/2015 Sato ..... H01R 4/184 439/519
2015/0126079 A1 * 5/2015 Kawamura ..... H01R 4/206 439/877
2015/0357725 A1 * 12/2015 Matsuo ..... C22C 9/00 439/877

* cited by examiner

COAXIAL-CABLE-ASSEMBLY, FERRULE, AND METHOD OF MAKING THE SAME

TECHNICAL FIELD OF INVENTION

This disclosure generally relates to a coaxial-cable assembly, and more particularly relates to a coaxial-cable assembly with a tubular-ferrule.

BACKGROUND OF INVENTION

It is known to crimp a solid tubular-ferrule around a coaxial-cable to terminate an outer-shield conductor. The deformation of the crimped tubular-ferrule is unpredictable and may result in undesirable geometries.

SUMMARY OF THE INVENTION

Described herein is a coaxial-cable-assembly that utilizes a tubular-ferrule designed to control the flow of material during the crimping operation. The coaxial-cable-assembly provides for a more uniform dimension of the crimped tubular-ferrule, improving the retention of the tubular-ferrule and eliminating irregular geometries of the surface of the tubular-ferrule that may be created during the crimping process.

In accordance with one embodiment, a coaxial-cable-assembly is provided. The coaxial-cable-assembly includes a coaxial-cable and a tubular-ferrule. The coaxial-cable has an outer-jacket and an exposed outer-shield conductor. The tubular-ferrule has a crimp-zone, a skirt-zone, and a transition-zone therebetween. The tubular-ferrule defines a relief-slot having an open-end, a closed-end, and two parallel-edges that extend from the crimp-zone to the skirt-zone. The crimp-zone is brought into forcible contact with the exposed outer-shield conductor by drawing the two parallel-edges into close proximity, such that a crimp-zone-diameter is reduced to less than a skirt-zone-diameter. The closed-end of the relief-slot forms an aperture in a junction of the transition-zone and the skirt-zone.

In another embodiment, a tubular-ferrule is provided that is configured to be attached to a coaxial-cable, with the coaxial-cable having an outer-jacket and an exposed outer-shield conductor. The tubular-ferrule includes a crimp-zone, a skirt-zone, and a transition-zone therebetween. The tubular-ferrule defines a relief-slot having an open-end, a closed-end, and two parallel-edges that extend from the crimp-zone to the skirt-zone. The tubular-ferrule is configured so that the crimp-zone is brought into forcible contact with the exposed outer-shield conductor of the coaxial-cable by drawing the two parallel-edges into close proximity. As a result, a crimp-zone-diameter is reduced to less than a skirt-zone-diameter, thereby causing the closed-end of the relief-slot to form an aperture in a junction of the transition-zone and the skirt-zone.

In yet another embodiment, a method of forming a coaxial-cable assembly is provided. The method includes the step of providing a coaxial-cable. The method also includes the step of providing a tubular-ferrule having a crimp-zone, a skirt-zone, and a transition-zone therebetween, wherein the tubular-ferrule includes a relief-slot having an open-end, a closed-end, and two parallel-edges that extend from the crimp-zone to the skirt-zone. The method also includes the step of removing a portion of an outer-jacket of the coaxial-cable to expose an outer-shield conductor. The method also includes the step of placing the tubular-ferrule over the coaxial-cable such that the crimp-zone envelops the exposed outer-shield conductor and the skirt-zone envelops the outer-jacket attached to the coaxial-cable. The method also includes the step of drawing the two parallel-edges into close proximity such that the crimp-zone-diameter is reduced to less than the skirt-zone-diameter, with the crimp-zone forcibly contacting the exposed outer-shield conductor. The method also includes the step of forming the closed-end into an aperture in a junction of the transition-zone and the skirt-zone.

Further features and advantages will appear more clearly on a reading of the following detailed description of the preferred embodiment, which is given by way of non-limiting example only and with reference to the accompanying drawings.

BRIEF DESCRIPTION OF DRAWINGS

The present invention will now be described, by way of example with reference to the accompanying drawings, in which.

The reference numbers of similar elements in the embodiments shown in the various figures share the last two digits.

DETAILED DESCRIPTION

Figure 1A:
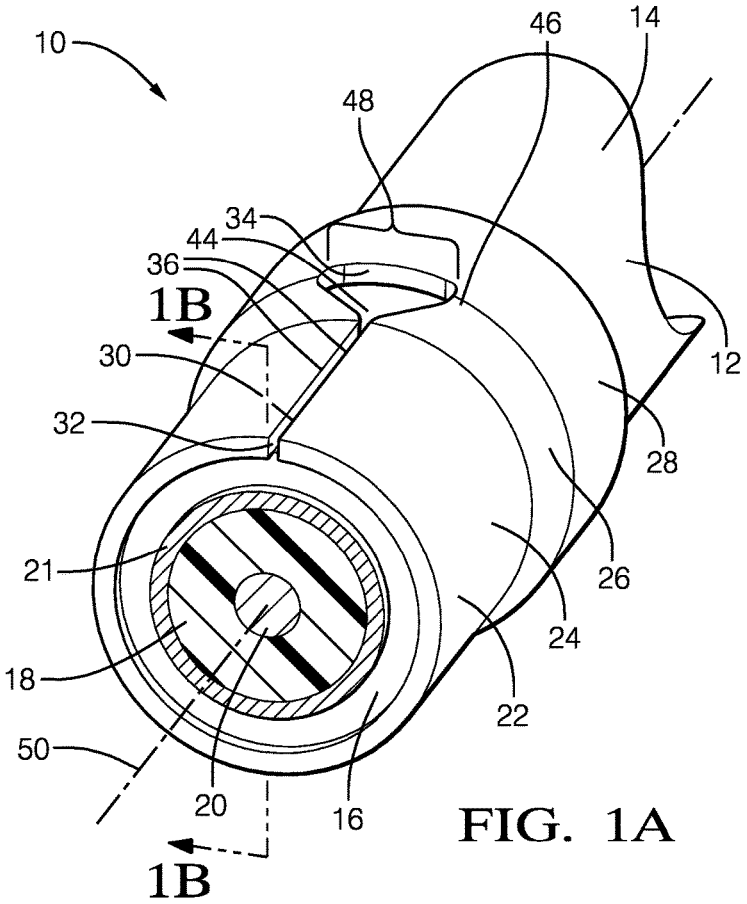
FIG. 1A is a perspective view of a coaxial-cable-assembly in accordance with a first embodiment.
Figure 1B:
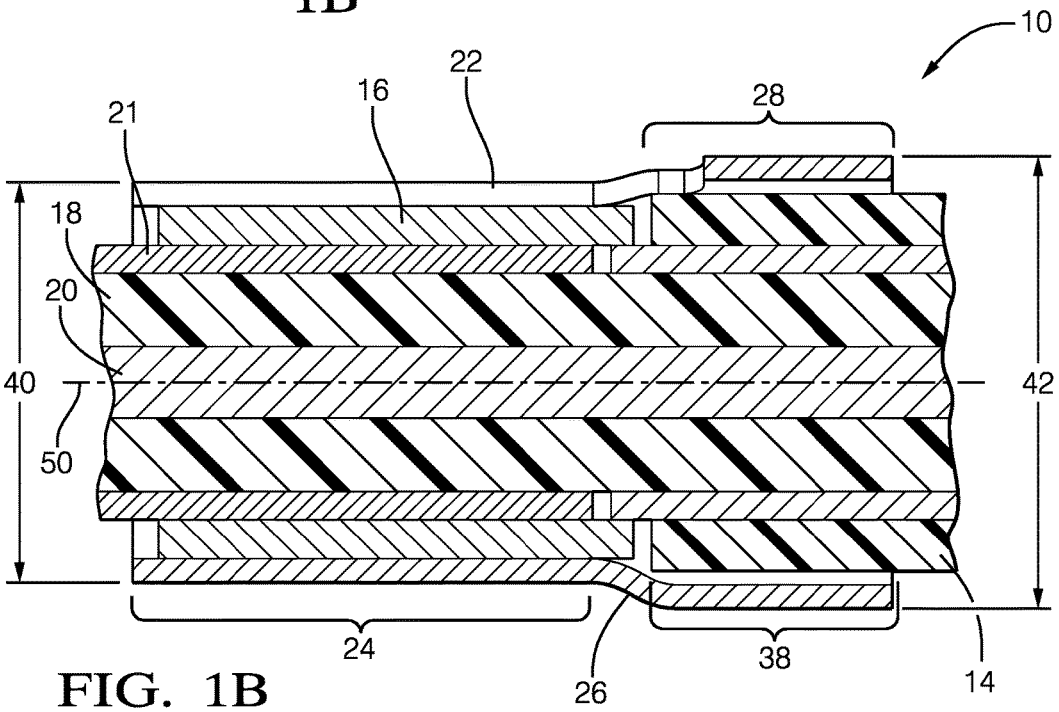
FIG. 1B is a cross-section view of the coaxial-cable-assembly of FIG. 1A in accordance with the first embodiment.

FIGS. 1A and 1B illustrate a non-limiting example of a coaxial-cable-assembly 10, comprising a coaxial-cable 12 having an outer-jacket 14 of insulating polymeric material, an exposed outer-shield conductor 16, a dielectric 18, and a center-conductor 20. The exposed outer-shield conductor 16 extends beyond an end of the outer-jacket 14 to an end of the dielectric 18. The dielectric 18 is surrounded by the outer-shield conductor 16 that electrically shields the center-conductor 20, as will be recognized by one skilled in the art. The coaxial-cable 12 may be any coaxial-cable 12 suitable for use in an automotive environment including, but not limited to, coaxial-cables 12 with the designations RG-58, RG-174, and RG-316, manufactured by Belden, Incorporated of St. Louis, Mo., USA. The coaxial-cable-assembly 10 may include an outer-terminal 21 in electrical contact with the outer-shield conductor 16 to promote an interconnection with a mating connector (not shown).

The coaxial-cable-assembly 10 also includes a tubular-ferrule 22. The tubular-ferrule 22 includes a crimp-zone 24, a transition-zone 26, and a skirt-zone 28. The transition-zone 26 is located between the crimp-zone 24 and the skirt-zone 28. The tubular-ferrule 22 may be fabricated to any length necessary to meet the connection requirements. The length of the skirt-zone 28 may be in a range of between twenty-percent (20%) and 30% of the total length of the tubular-ferrule 22. Advantageously, the tubular-ferrule 22 may be fabricated from a drawn-metal (i.e. seamless) tube to eliminate the step of forming the tubular-ferrule 22 from flat sheet-stock, thereby improving the dimensional control of the tubular-ferrule 22. The tubular-ferrule 22 may be fabricated from an electrically conductive material suitable for use in automotive environments, including, but not limited to, aluminum-based materials and copper-based materials. The tubular-ferrule 22 may be coated with a conductive material including, but not limited to, tin-based coatings. The wall-thickness of the tubular-ferrule 22 may vary based on a diameter of the coaxial-cable 12, as will be recognized by one skilled in the art.

The tubular-ferrule 22 defines a relief-slot 30 having an open-end 32, a closed-end 34, and two parallel-edges 36. The parallel-edges 36 extend from the crimp-zone 24 to the skirt-zone 28 and a portion of the parallel-edges 36 within the crimp-zone 24 are drawn into close proximity causing the crimp-zone 24 to forcibly contact the exposed outer-shield conductor 16 while the skirt-zone 28 overlaps 38 the outer-jacket 14 (FIG. 1B). As a result of drawing the parallel-edges 36 into close proximity, a crimp-zone-diameter 40 is reduced to less than a skirt-zone-diameter 42 (FIG. 1B), and the closed-end 34 of the relief-slot 30 forms an aperture 44 in a junction 46 of the transition-zone 26 and the skirt-zone 28. The formation of the aperture 44 creates a sufficient force between the crimp-zone 24 and the outer-shield conductor 16 to retain the tubular-ferrule 22 on the coaxial-cable 12, such that the tubular-ferrule 22 may resist a pull-force in the range of between 110 Newtons (110 N) and 170 N. The shape of the aperture 44 is laterally elongated 48 due to a plastic-deformation of the material in the transition-zone 26.

In a first embodiment of the coaxial-cable-assembly 10, FIG. 1A illustrates a non-limiting example of the tubular-ferrule 22 with the two parallel-edges 36 being aligned parallel to a longitudinal-axis 50 of the tubular-ferrule 22.

Figure 2A:
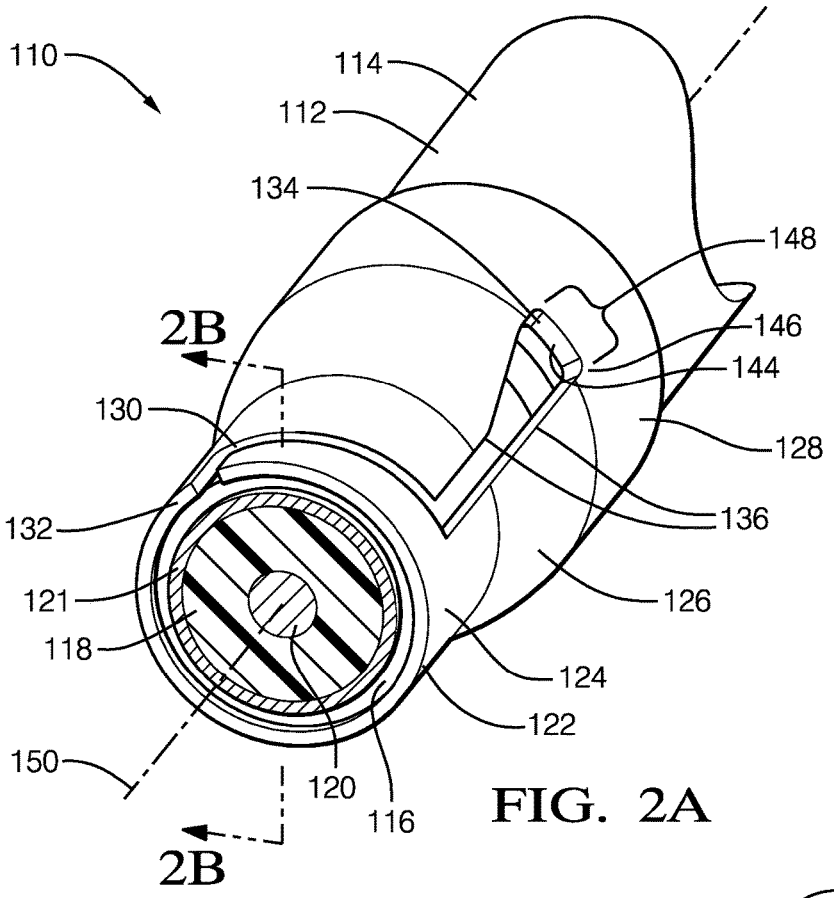
FIG. 2A is a perspective view of a coaxial-cable-assembly in accordance with a second embodiment.

In a second embodiment of a coaxial-cable-assembly 110, FIG. 2A illustrates a tubular-ferrule 122 with a segment of two parallel-edges 136 within a crimp-zone 124 being aligned transverse to a longitudinal-axis 150 of the coaxial-cable-assembly 110. The non-limiting example illustrated in FIG. 2A is shown having a single segment of the two parallel-edges 136 aligned at ninety-degrees (90°) to the longitudinal-axis 150 of the tubular-ferrule 122. Other angles transverse (i.e. between 0° and 180°) to the longitudinal-axis 150 of the tubular-ferrule 122, as well as multiple segments of the two parallel-edges 136 are contemplated, but not shown.

Figure 3A:
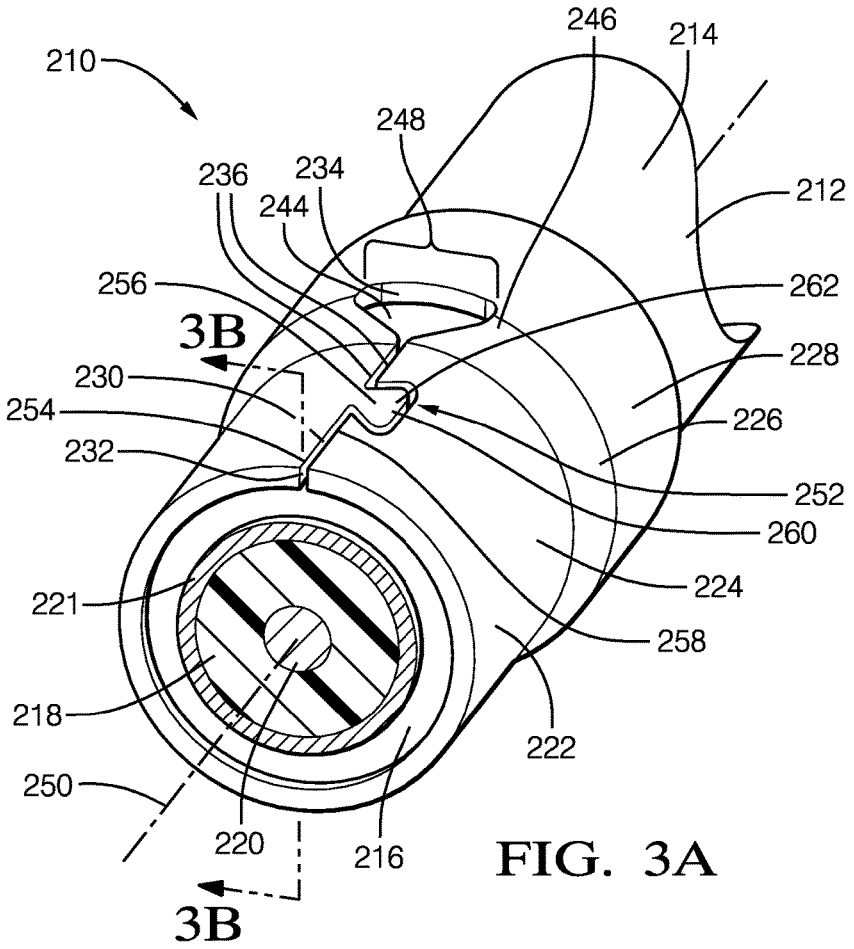
FIG. 3A is a perspective view of a coaxial-cable-assembly in accordance with a third embodiment.

In a third embodiment of a coaxial-cable-assembly 210, FIG. 3A illustrates a tubular-ferrule 222 configured with a locking-feature 252 with a first-edge 254 of two parallel-edges 236 defining a projection 256, and a second-edge 258 of the two-parallel-edges 236 defining a corresponding interlocking-notch 260. The projection 256 and the interlocking-notch 260 are configured to have a trapezoidal-shape 262. Other shapes of the locking-feature 252 are contemplated, but not shown, and may include circular and rectilinear shapes that may provide a similar interlocking function.

Figure 4:
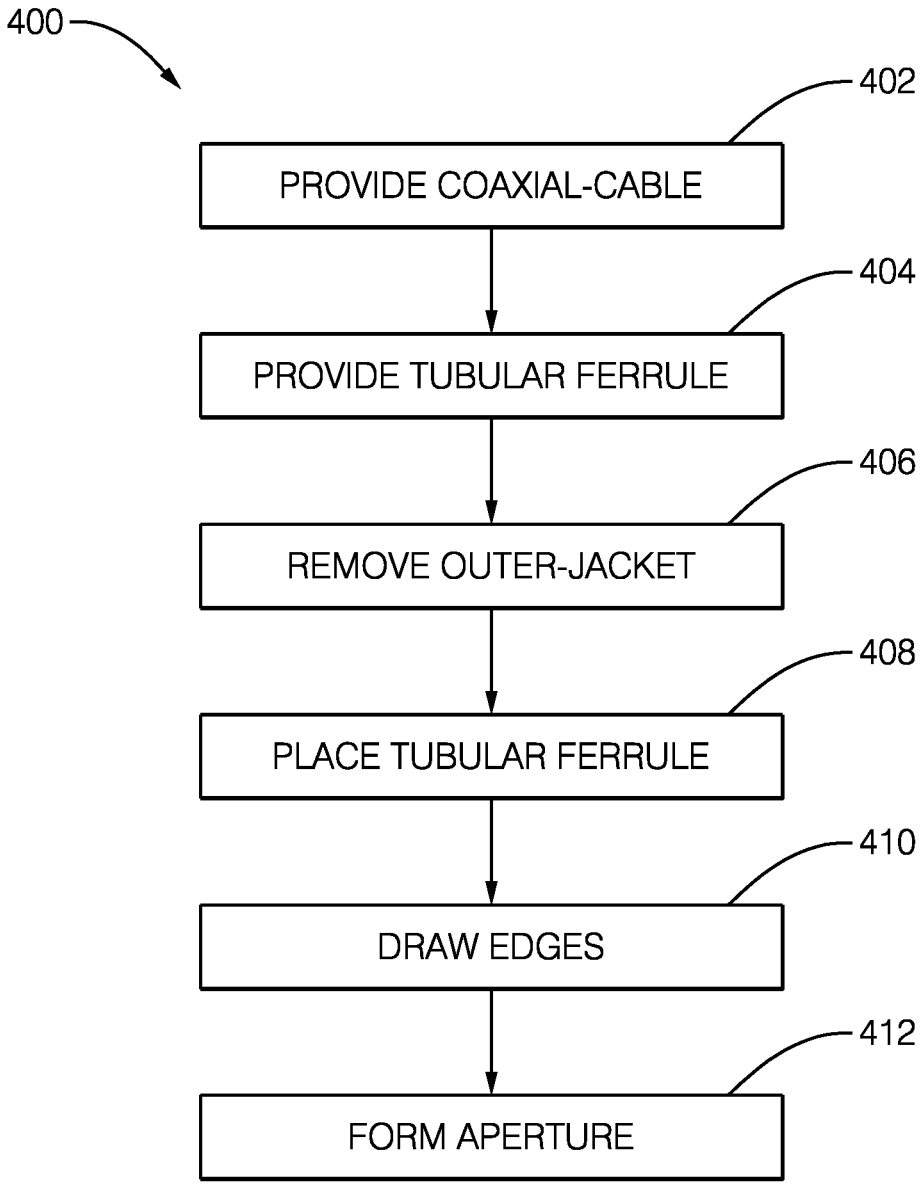
FIG. 4 is a flow chart of a method of forming the coaxial-cable-assemblies of the preceding embodiments shown in FIGS. 1A-3B.

FIG. 4 is a flowchart that illustrates a non-limiting example of a method 400 of forming the coaxial-cable-assembly 10.

Step 402, PROVIDE COAXIAL-CABLE, may include providing a coaxial-cable 12 having an outer-jacket 14 of insulating polymeric material, an outer-shield conductor 16, a dielectric 18, and a center-conductor 20 (FIG. 1). The dielectric 18 is surrounded by the outer-shield conductor 16 that electrically shields the center-conductor 20, as will be recognized by one skilled in the art. The coaxial-cable 12 may be any coaxial-cable 12 suitable for use in an automotive environment including, but not limited to, coaxial-cables 12 with the designations RG-58, RG-174, and RG-316, manufactured by Belden, Incorporated of St. Louis, Mo., USA. The coaxial-cable-assembly 10 may include an outer-terminal 21 in electrical contact with the outer-shield conductor 16 to promote an interconnection with a mating connector (not shown).

Step 404, PROVIDE TUBULAR FERRULE, may include providing a tubular-ferrule 22 that includes a crimp-zone 24, a transition-zone 26, and a skirt-zone 28. The transition-zone 26 is located between the crimp-zone 24 and the skirt-zone 28. The tubular-ferrule 22 defines a relief-slot 30 having an open-end 32, a closed-end 34, and two parallel-edges 36. The parallel-edges 36 extend from the crimp-zone 24 to the skirt-zone 28. The tubular-ferrule 22 may be fabricated to any length necessary to meet the connection requirements. The length of the skirt-zone 28 may be in a range of between twenty-percent (20%) and 30% of the total length of the tubular-ferrule 22. Advantageously, the tubular-ferrule 22 may be fabricated from a drawn-metal (i.e. seamless) tube to eliminate the step of forming the tubular-ferrule 22 from flat sheet-stock, thereby improving the dimensional control of the tubular-ferrule 22. The tubular-ferrule 22 may be fabricated from an electrically conductive material suitable for use in automotive environments, including, but not limited to, aluminum-based materials and copper-based materials. The tubular-ferrule 22 may be coated with a conductive material including, but not limited to, tin-based coatings. The wall-thickness of the tubular-ferrule 22 may vary based on a diameter of the coaxial-cable 12.

Step 406, REMOVE OUTER-JACKET, may include removing a portion of the outer-jacket 14 from a cut-end of the coaxial-cable 12 to expose the outer-shield conductor 16. A length of the outer-jacket 14 removed may be equal to a length of the crimp-zone 24 of the tubular-ferrule 22. The outer-jacket 14 may be removed using any of the known techniques of wire-stripping as will be recognized by one skilled in the art.

Step 408, PLACE TUBULAR FERRULE, may include placing the tubular-ferrule 22 over the coaxial-cable 12 such that the crimp-zone 24 envelops the exposed outer-shield conductor 16 and the skirt-zone 28 envelops the outer-jacket 14 attached to the coaxial-cable 12. The cut-end of the coaxial-cable 12 may be inserted into the tubular-ferrule 22 using known methods for material handling and will be understood by one skilled in the art.

Step 410, DRAW EDGES, may include drawing a portion of the two parallel-edges 36 within the crimp-zone 24 into close proximity such that a crimp-zone-diameter 40 is reduced to less than a skirt-zone-diameter 42. The parallel-edges 36 extend from the crimp-zone 24 to the skirt-zone 28 and a portion of the two parallel-edges 36 within the crimp-zone 24 are drawn into close proximity causing the crimp-zone 24 to forcibly contact the exposed outer-shield conductor 16 while the skirt-zone 28 overlaps 38 the outer-jacket 14 (FIG. 1B). As a result of drawing the parallel-edges 36 into close proximity, the crimp-zone-diameter 40 is reduced to less than the skirt-zone-diameter 42. The parallel-edges 36 may be drawn into close-proximity by using any of the methods of crimping known to one skilled in the art.

In a first embodiment of the coaxial-cable-assembly 10, FIG. 1A illustrates a tubular-ferrule 22 with the two parallel-edges 36 being aligned parallel to a longitudinal-axis 50 of the tubular-ferrule 22. FIG. 1B illustrates a cross-section of the coaxial-cable-assembly 10 of FIG. 1A.

Figure 2B:
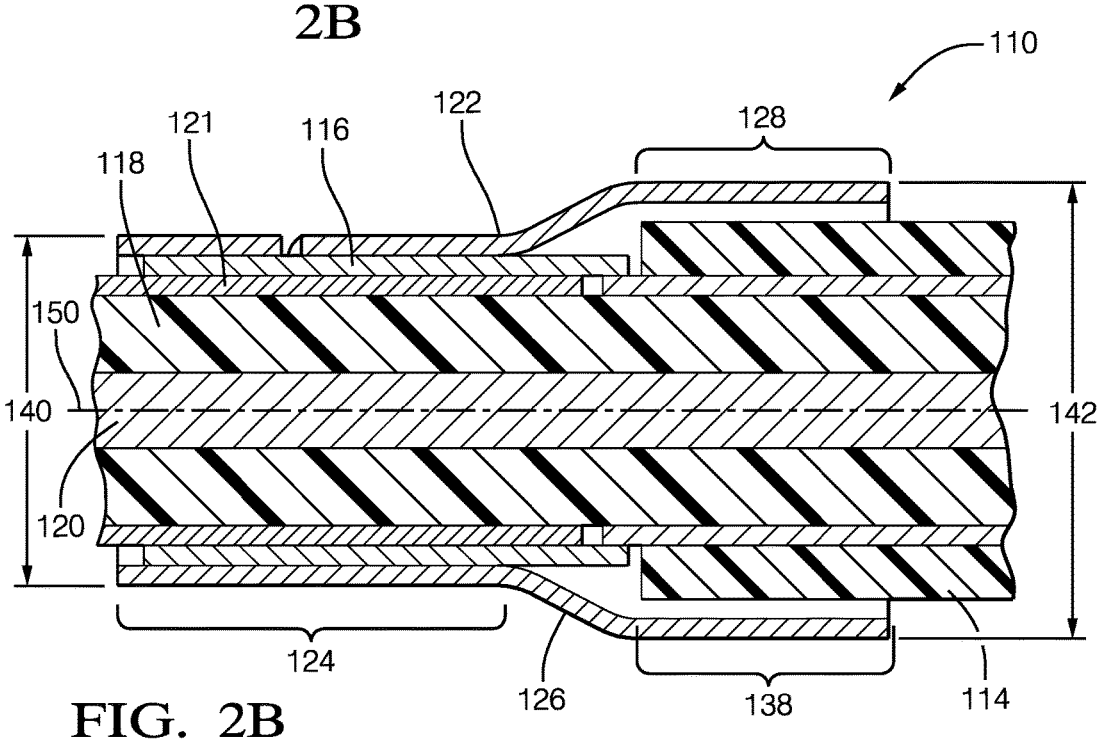
FIG. 2B is a cross-section view of the coaxial-cable-assembly of FIG. 2A in accordance with the second embodiment.

In a second embodiment of a coaxial-cable-assembly 110, FIG. 2A illustrates a tubular-ferrule 122 with a segment of two parallel-edges 136 within a crimp-zone 124 being aligned transverse to a longitudinal-axis 150 of the tubular-ferrule 122. The non-limiting example illustrated in FIG. 2A is shown having a single segment of the two parallel-edges 136 aligned at ninety-degrees (90°) to the longitudinal-axis 150 of the tubular-ferrule 122. Other angles transverse (i.e. between 0° and 180°) to the longitudinal-axis 150 of the tubular-ferrule 122, as well as multiple segments of the two parallel-edges 136 are contemplated, but not shown. FIG. 2B illustrates a cross-section of the coaxial-cable-assembly 110 of FIG. 2A.

Figure 3B:
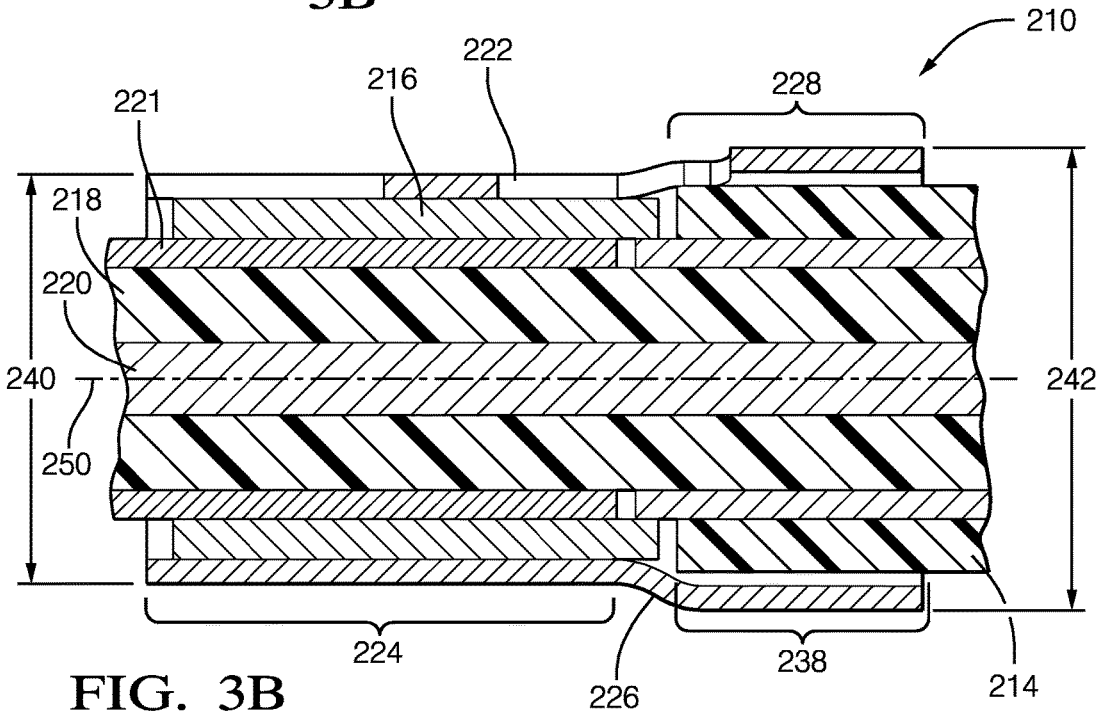
FIG. 3B is a cross-section view of the coaxial-cable-assembly of FIG. 3A in accordance with the third embodiment.

In a third embodiment of a coaxial-cable-assembly 210, FIG. 3A illustrates a tubular-ferrule 222 configured with a locking-feature 252 with a first-edge 254 of two parallel-edges 236 defining a projection 256, and a second-edge 258 of the two-parallel-edges 236 defining a corresponding interlocking-notch 260. The projection 256 and the interlocking-notch 260 are configured to have a trapezoidal-shape 262. Other shapes of the locking-feature 252 are contemplated, but not shown, and may include circular and rectilinear shapes, or any combination thereof, that may provide a similar interlocking function. FIG. 3B illustrates a cross-section of the coaxial-cable-assembly 210 of FIG. 3A.

Step 412, FORM APERTURE, may include forming the closed-end 34 into an aperture 44 in a junction 46 of the transition-zone 26 and the skirt-zone 28. The formation of the aperture 44 creates a sufficient force between the crimp-zone 24 and the outer-shield conductor 16 to retain the tubular-ferrule 22 on the coaxial-cable 12, such that the tubular-ferrule 22 may resist a pull-force in the range of between 110 Newtons (110 N) and 170 N. The shape of the aperture 44 is laterally elongated 48 due to a plastic-deformation of the material in the transition-zone 26.

Accordingly, a coaxial-cable-assembly 10, a tubular-ferrule 22 for the coaxial-cable-assembly 10 and a method 400 of forming the coaxial-cable-assembly 10 provided. The coaxial-cable-assembly 10 provides for a more uniform dimension of the crimped tubular-ferrule 22 that improves the retention of the tubular-ferrule 22 and eliminates irregular geometries of the surface of the tubular-ferrule 22 that may be created during the crimping process.

While this invention has been described in terms of the preferred embodiments thereof, it is not intended to be so limited, but rather only to the extent set forth in the claims that follow. Moreover, the use of the terms first, second, upper, lower, etc. does not denote any order of importance, location, or orientation, but rather the terms first, second, etc. are used to distinguish one element from another. Furthermore, the use of the terms a, an, etc. do not denote a limitation of quantity, but rather denote the presence of at least one of the referenced items.

I claim:

1. A coaxial-cable-assembly comprising:

a coaxial-cable having an outer-jacket and an exposed outer-shield conductor;

a tubular-ferrule having a crimp-zone, a seamless skirt-zone, and a transition-zone therebetween, said tubular-ferrule defining a relief-slot having an open-end, a closed-end, and two parallel-edges that extend from the crimp-zone to the seamless skirt-zone, wherein the crimp-zone is brought into forcible contact with the exposed outer-shield conductor by drawing a portion of the two parallel-edges into close proximity such that a crimp-zone-diameter is reduced to less than a skirt-zone-diameter, and wherein the closed-end of the relief-slot forms an aperture in a junction of the transition-zone and the seamless skirt-zone, wherein the seamless skirt-zone overlaps the outer-jacket, and wherein the seamless skirt-zone is not crimped.

2. The coaxial-cable-assembly in accordance with claim 1, wherein the aperture is laterally elongated.

3. The coaxial-cable-assembly in accordance with claim 1, wherein the two parallel-edges are aligned parallel to a longitudinal-axis of the tubular-ferrule.

4. The coaxial-cable-assembly in accordance with claim 3, wherein a segment of the two parallel-edges within the crimp-zone are aligned transverse to the longitudinal-axis of the tubular-ferrule.

5. The coaxial-cable-assembly in accordance with claim 1, wherein a first-edge of the two parallel-edges defines a projection and wherein a second-edge of the two parallel-edges defines a corresponding interlocking-notch.

6. The coaxial-cable-assembly in accordance with claim 5, wherein the projection and the interlocking-notch each define a corresponding trapezoidal-shape.

7. A tubular-ferrule configured to be attached to a coaxial-cable, said coaxial-cable having an outer-jacket and an exposed outer-shield conductor, comprising:

a crimp-zone;

a seamless skirt-zone; and a transition-zone therebetween, said tubular-ferrule defining a relief-slot having an open-end, a closed-end, and two parallel-edges that extend from the crimp-zone to the seamless skirt-zone, wherein the tubular-ferrule is configured so that the crimp-zone is brought into forcible contact with the exposed outer-shield conductor of said coaxial-cable by drawing a portion of the two parallel-edges into close proximity such that a crimp-zone-diameter is reduced to less than a skirt-zone-diameter, thereby causing the closed-end of the relief-slot to form an aperture in a junction of the transition-zone and the seamless skirt-zone, wherein the seamless skirt-zone is configured to overlap the outer-jacket of the coaxial-cable, and wherein the seamless skirt-zone is not crimped.

8. The tubular-ferrule in accordance with claim 7, wherein the aperture is laterally elongated.

9. The tubular-ferrule in accordance with claim 7, wherein the two parallel-edges are configured to be aligned parallel to a longitudinal-axis of the tubular-ferrule.

10. The tubular-ferrule in accordance with claim 9, wherein a segment of the two parallel-edges within the crimp-zone are configured to be aligned transverse to the longitudinal-axis of the tubular-ferrule.

11. The tubular-ferrule in accordance with claim 7, wherein a first-edge of the two parallel-edges defines a projection and wherein a second-edge of the two parallel-edges defines a corresponding interlocking-notch.

12. The tubular-ferrule in accordance with claim 11, wherein the projection and the interlocking-notch each define a corresponding trapezoidal-shape.

13. A method of forming a coaxial-cable assembly, comprising the steps of:

providing a coaxial-cable;

providing a tubular-ferrule having a crimp-zone, a seamless skirt-zone, and a transition-zone therebetween, wherein said tubular-ferrule includes a relief-slot having an open-end, a closed-end, and two parallel-edges that extend from the crimp-zone to the seamless skirt-zone;

removing a portion of an outer-jacket of the coaxial-cable to expose an outer-shield conductor;

placing the tubular-ferrule over the coaxial-cable such that the crimp-zone envelops an exposed outer-shield conductor and the seamless skirt-zone envelops the outer-jacket attached to the coaxial-cable;

drawing a portion of the two parallel-edges into close proximity such that a crimp-zone-diameter is reduced to less than a skirt-zone-diameter, said crimp-zone forcibly contacting the exposed outer-shield conductor, wherein the seamless skirt-zone is not crimped; and forming the closed-end into an aperture in a junction of the transition-zone and the seamless skirt-zone.

14. The method of claim 13, wherein the two parallel-edges are configured to be aligned parallel to a longitudinal-axis of the tubular-ferrule.

15. The method of claim 13, wherein a segment of the two parallel-edges within the crimp-zone are configured to be aligned transverse to a longitudinal-axis of the tubular-ferrule.

16. The method of claim 13, wherein a first-edge of the two parallel-edges defines a projection and wherein a second-edge of the two parallel-edges defines a corresponding interlocking-notch, and wherein the step of drawing the two parallel-edges into close proximity further comprises the step of placing the projection within the interlocking-notch.

17. The method of claim 16, wherein the projection and the interlocking-notch each define a corresponding trapezoidal-shape.

* * * * *